United States Patent [19]

Shapiro et al.

[11] 4,249,942

[45] Feb. 10, 1981

[54] COPPER BASE ALLOY CONTAINING MANGANESE AND COBALT

[75] Inventors: Eugene Shapiro, Hamden; John M. Vitek, Cheshire; Warren F. Smith, Jr., Branford, all of Conn.

[73] Assignee: Olin Corporation, New Haven, Conn.

[21] Appl. No.: 74,535

[22] Filed: Sep. 11, 1979

[51] Int. Cl.[3] ..... C22C 9/04

[52] U.S. Cl. ..... 75/157.5; 75/161; 75/162; 148/11.5 C; 148/13.2

[58] Field of Search ..... 75/157.5, 161, 162; 148/11.5 C, 13.2

[56] References Cited

U.S. PATENT DOCUMENTS

| | | | |
|---|---|---|---|
| 1,869,554 | 8/1932 | Ellis | 75/157.5 |
| 2,101,930 | 12/1937 | Davis et al. | 75/157.5 |
| 2,400,234 | 5/1946 | Hudson | 75/157.5 |
| 2,479,596 | 8/1949 | Anderson et al. | 75/157.5 |
| 2,494,736 | 1/1950 | Berwick | 75/157.5 |
| 3,097,093 | 7/1963 | Fox et al. | 75/157.5 |
| 3,402,043 | 9/1968 | Smith | 75/157.5 |
| 3,764,306 | 10/1973 | Blythe et al. | 75/157.5 |
| 3,841,921 | 10/1974 | Shapiro et al. | 148/11.5 C X |
| 3,941,619 | 3/1976 | Shapiro et al. | 148/11.5 C X |
| 4,025,367 | 5/1977 | Parikh et al. | 148/11.5 C |

FOREIGN PATENT DOCUMENTS

| | | | |
|---|---|---|---|
| 853620 | 10/1970 | Canada | 75/157.5 |
| 833288 | 4/1960 | United Kingdom | 75/157.5 |
| 838762 | 6/1960 | United Kingdom | 75/157.5 |

*Primary Examiner*—R. Dean
*Assistant Examiner*—W. G. Saba
*Attorney, Agent, or Firm*—Paul Weinstein

[57] ABSTRACT

A copper base alloy having improved stress relaxation resistance consisting essentially of about 10.0 to 31% zinc; about 1.0 to 5.0% aluminum; about 0.1 to 3.0% cobalt; about 0.5 to 8% manganese; and the balance essentially copper.

10 Claims, 2 Drawing Figures

COPPER BASE ALLOY CONTAINING MANGANESE AND COBALT

BACKGROUND OF THE INVENTION

Material used for spring connection devices must exhibit the ability to maintain adequate contact pressure for the design life of any part formed from the material. The maintenance of adequate contact pressure requires the ability of the material to resist stress relaxation over a period of time especially at elevated temperatures above normal room temperature. The current trend in connector design has been to place greater emphasis upon the maintenance of high contact pressure on connector parts at mildly elevated temperatures to reduce problems which might develop as the surface temperatures of the parts increase. CDA Alloy C68800 is currently widely used for electrical connectors but tends to exhibit a less than desired stress relaxation resistance at temperatures of 75° C. or higher. Accordingly, it is desirable that this alloy be modified in such a manner so as to improve its elevated temperature stress relaxation performance.

It is important in any modification of CDA Alloy C68800 that a reasonable level of conductivity be maintained along with the improved stress relaxation performance. Furthermore, bend formability should be maintained as well as its other desirable strength properties. Other performance characteristics such as stress corrosion, solderability and softening resistance should not be significantly below those properties exhibited by the commercial CDA Alloy C68800. It is desired in accordance with this invention that the improved alloy exhibit approximately a 10 to 30% increase in projected stress remaining after 100,000 hours at 105° C. relative to the commercially available CDA Copper Alloy C68800. That alloy is included within the limits of U.S. Pat. No. 3,402,043 to Smith.

It has surprisingly been found that when an alloy as disclosed in the Smith patent is modified through the addition of manganese within specific limits its stress relaxation performance is substantially improved while maintaining excellent strength and bend properties and with a limited degree of conductivity loss. In the Smith patent manganese is disclosed for addition only as a common impurity.

Various attempts have been made to improve the stress relaxation performance of CDA Copper Alloy C68800 and related alloys and also to improve other properties of these alloys by modification of their processing as exemplified in U.S. Pat. Nos.: 3,841,921 and 3,941,619 to Shapiro et al. and 4,025,367 to Parikh et al. The Shapiro et al. 3,841,921 patent is particularly pertinent in that it deals with improving the stress relaxation resistance of the desired alloys which are broadly defined and which may include up to 10% manganese as one of many possible alternative alloying additions.

U.S. Pat. No. 1,869,554 to Ellis is of interest and it discloses a brass alloy including 2 to 7% manganese. The alloy comprises a beta or alpha plus beta alloy and generally includes a level of zinc well above that included in the alloy of the present invention. In U.S. Pat. No. 3,764,306 to Blythe et al. a prior art alloy is disclosed comprising an aluminum-brass including from 6 to 30% manganese.

In U.S. Pat. No. 2,101,930 to Davis et al. an aluminum-brass is disclosed having optionally up to 1% manganese. In U.S. Pat. No. 2,400,234 to Hudson a nickel-aluminum-brass is disclosed having from 0.5 to 2.5% manganese. None of the patents to Ellis, Blythe et al., Davis et al. and Hudson disclose an alloy within the ranges of this invention.

British Pat. No. 833,288 discloses a beta brass including aluminum, iron and nickel or cobalt and optionally manganese. British Pat. No. 838,762 discloses a copper, zinc, titanium and/or zirconium alloy which may include 0.25 to 2% of one or more of the metals chromium, manganese, iron, cobalt and nickel.

SUMMARY OF THE INVENTION

The present invention relates to an alloy having improved stress relaxation resistance while maintaining good bend formability, high strength and acceptable electrical conductivity. The alloy comprises a modified version of CDA Copper Alloy C68800. The copper base alloy of this invention consists essentially of: zinc from about 10.0 to 31% by weight; aluminum from about 1.0 to about 5.0% by weight; cobalt from about 0.1 to 3.0% by weight; manganese from about 0.5 to 8% by weight; and the balance essentially copper. Preferably, the manganese content of the alloy is from about 0.8 to 6% and most preferably from about 1.1% to about 4%. Preferably, the zinc content is from about 15 to 25%. The preferred aluminum is from about 2.0 to 4% and most preferably from about 2.5 to 3.8%. The cobalt content preferably is from about 0.1 to 1% and most preferably from about 0.1 to 0.5%.

Silicon is preferably less than 0.2%. Other elements may be present in desired amounts which will not adversely affect the properties may be included, though preferably at impurity levels.

The alloys as above noted provide substantially improved stress relaxation resistance at elevated temperatures, as compared to presently available commercial alloys, such as CDA Copper Alloy C68800.

Accordingly, it is an object of this invention to provide an improved aluminum-brass alloy having improved stress relaxation resistance.

It is a further object of this invention to provide an alloy as above which is modified by the addition of manganese within desired limits.

These and other objects will become more apparent from the following description and drawings.

DETAILED DESCRIPTION OF PREFERRED EMBODIMENTS

Figure 1:
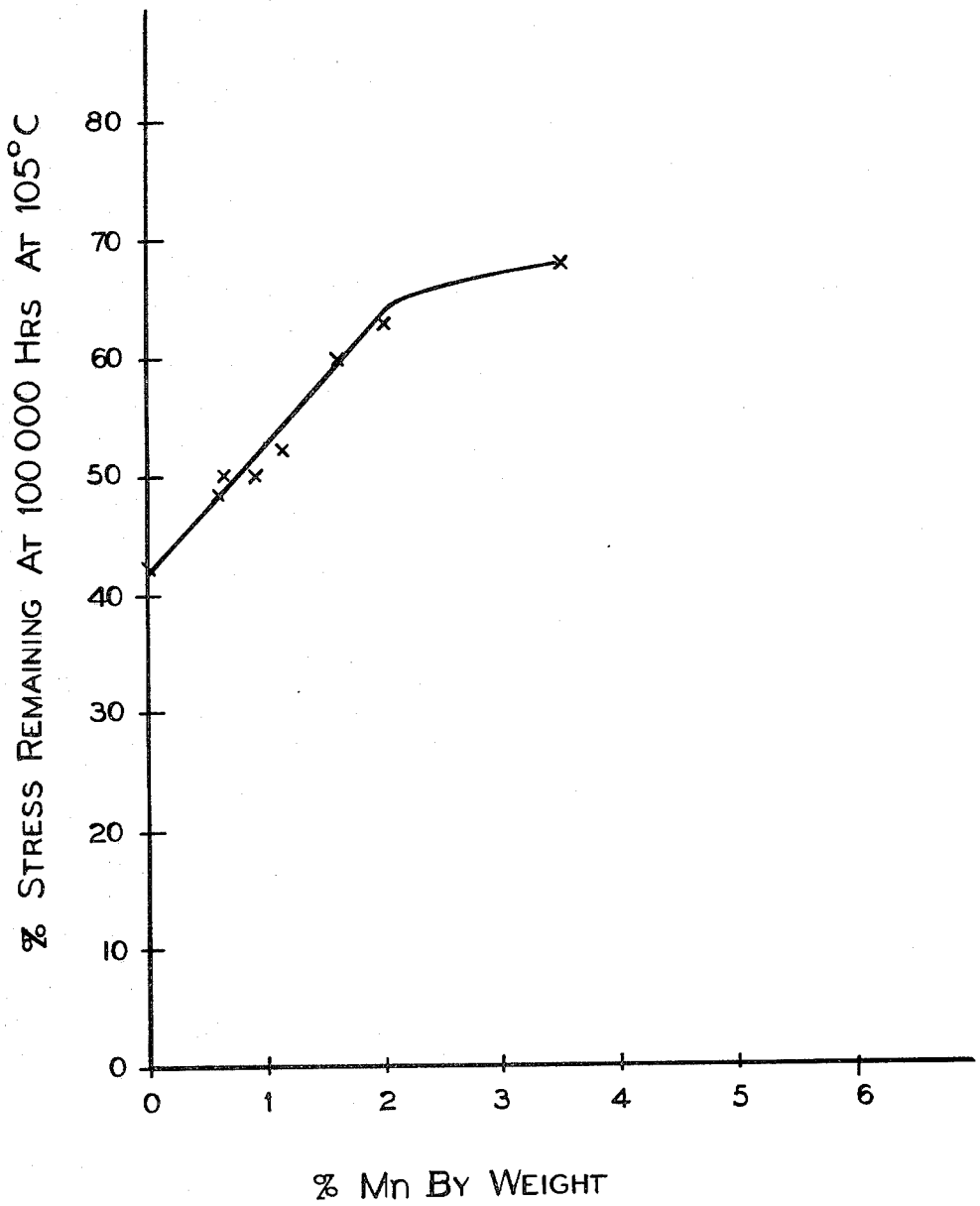
FIG. 1 is a graph showing the effect of the manganese content in the alloy of the present invention on stress relaxation resistance.

In accordance with the present invention it has been found that the foregoing objects can be readily and conveniently achieved with an alloy of the following composition. The improved alloy of the present invention consists essentially of the ingredients in the following ranges wherein all percentages are by weight:

about 10.0 to 31% zinc;
about 1.0 to 5.0% aluminum;
about 0.1 to 3.0% cobalt;
about 0.5 to 8% manganese; and
the balance essentially copper.

Preferably, the aforenoted alloy has a composition within the following ranges:

about 2.0 to 4% aluminum;
about 15 to 25% zinc;
about 0.1 to 1% cobalt;
about 0.8 to 6% manganese; and
the balance essentially copper.

Most preferably, the manganese content of the aforenoted alloy is from about 1.1 to about 4%, cobalt is from about 0.1 to 0.5% and aluminum is from about 2.5 to 3.8%. Silicon is preferably less than about 0.2%. Other elements may be present in amounts which will not adversely affect the properties of the alloy and preferably at or below impurity levels.

The base composition of the alloy of this invention is essentially the same as that described in U.S. Pat. No. 3,402,043 to Smith. The alloys of the present invention depart from those disclosed in the Smith patent by the addition of manganese for improving the stress relaxation resistance of the alloy while maintaining the other favorable properties of the alloy. Smith did not recognize that the addition of manganese within the limits set forth herein would surprisingly improve the stress relaxation resistance of his alloys. Accordingly, the patent to Smith is intended to be incorporated by reference herein.

The alloys of the present invention are known as modified aluminum-brasses and basically have either of the following structures after hot rolling and annealing: (1) an alpha (face centered cubic) and fine precipitate structure; or (2) an alpha plus a limited amount of beta (body centered cubic) and fine precipitate structure, preferably less than 10% beta. The alloy is preferably a single phase solid solution alloy comprising essentially all alpha phase. The presence of beta phase in the alloy should be avoided because it adversely affects the cold workability of the alloy. The ranges for the alloying elements other than manganese have been selected for essentially the same reasons as set forth in the Smith patent. Aluminum is added to the alloy for its strengthening effect and cobalt is added as a grain refining element.

The ranges in accordance with this invention are in every sense critical. The copper content should preferably fall within the range of 67 to 80% by weight. Above 80% by weight, the strength falls off markedly and below 67% by weight in saturated alloys an additional phase termed gamma having a complex cubic crystal structure may be encountered with slow cooling cycles which will limit the ductility of the alloy.

For maximum dictility-formability for any given copper-aluminum level the cobalt content should be between 0.1 and 1.0%. For greater strength and lesser ductility the cobalt may approach higher levels of up to 3%. Above this level of cobalt little improvement in properties is realized since excess cobalt appears as elemental particles or as massive cobalt plus aluminum intermetallic compound and in addition can cause ductility decreases. In general, the lower cobalt content alloys are high strength, high ductility materials whereas the higher cobalt alloys provide even higher strength but lower ductility.

The composition of specific alloys within the above ranges are subject to further internal restriction that at about the lower levels of copper the aluminum content should preferably be in the range of 1.2 to 3.2% in order to insure high ductility-strength characteristics and at the higher level of copper the aluminum content should preferably be between 3.0 and 5.0% for the same reasons. Proportionate adjustments of aluminum content for the various copper contents between specified limits should preferably be made. Furthermore, in order to obtain the preferred properties, the aluminum content should preferably be related to the zinc content in accordance with the following equation:

$$\text{Weight \% Aluminum} = -0.29 \text{ Weight \% } (Zn+Mn)+9.2\pm1.35$$

Processing of the alloys of the present invention requires no unusual treatment and is essentially similar to that described in U.S. Pat. No. 3,402,043.

The novel and improved characteristics of the alloys of this invention are associated with the addition of manganese in the range of from about 0.5 to 8%, and preferably from about 0.8 to 6%, and most preferably from about 1.1 to 4%.

The effect of manganese in the alloy of the present invention is clearly illustrated by reference to FIGS. 1 and 2. FIG. 1 is a graph showing the effect of the manganese content on percent stress remaining at 100,000 hours at 105° C. for a series of alloys having an initial 0.2% yield strength of about 100 ksi. It is apparent that up to about 2% manganese there is a sharp increase in the percent stress remaining with increasing manganese content. The presence of 0.5% manganese insures at least a 10% improvement in stress relaxation resistance, as compared to an alloy without manganese. Further, an alloy with in excess of 1% manganese will enjoy an improvement of at least 30% in stress relaxation resistance. Above 2% manganese, there is a leveling off of the improvement in stress relaxation resistance with increasing manganese content. Therefore, the most preferred range of manganese in accordance with this invention is from about 1.1% manganese to about 4% manganese.

Figure 2:
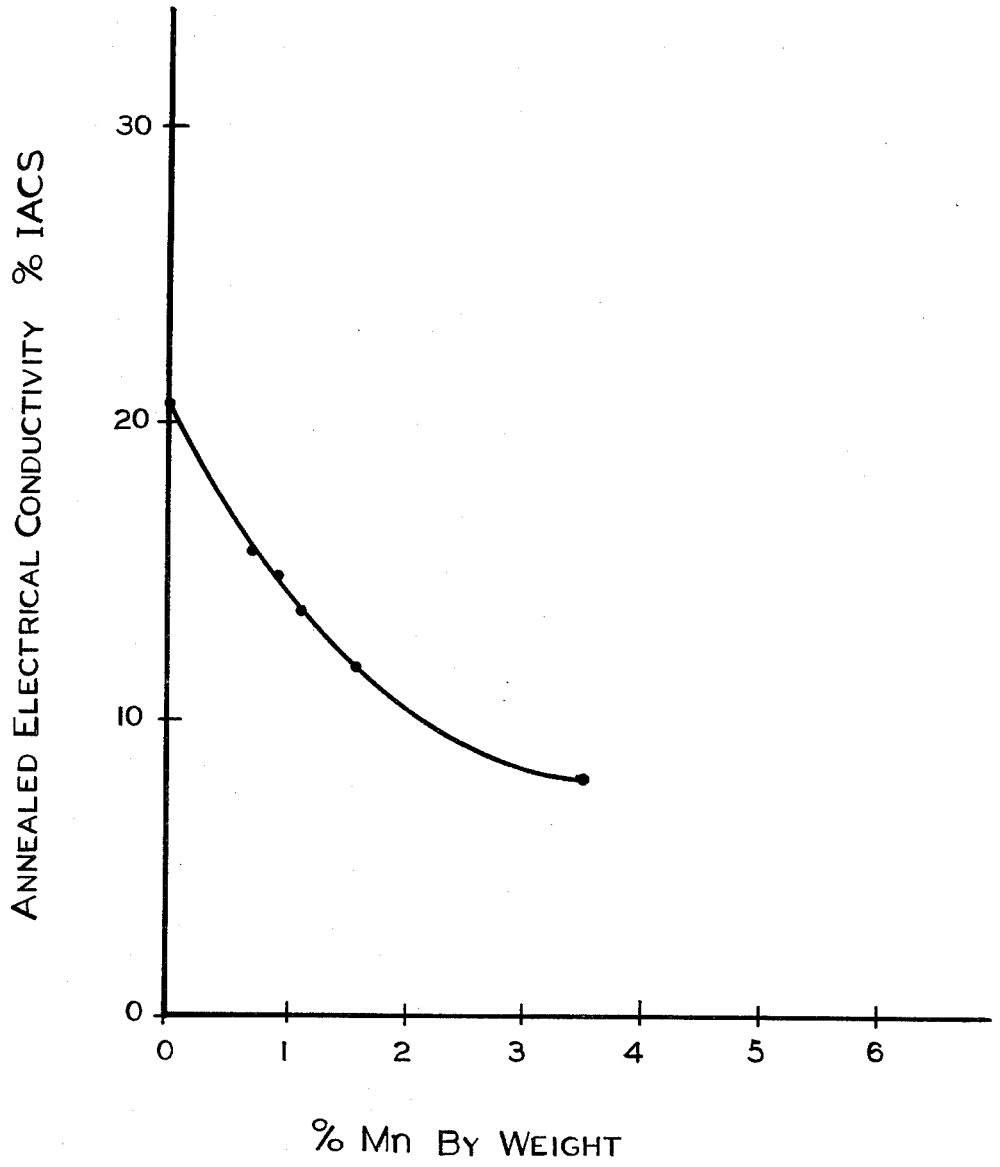
FIG. 2 is a graph showing the effect of manganese in the alloy of the present invention on electrical conductivity.

The upper limit of manganese is dictated by the adverse effect of manganese on the conductivity of the alloy as evidenced by a consideration of FIG. 2. It is apparent, however, that an alloy in accordance with the present invention having 0.5% manganese will still achieve an electrical conductivity in excess of 15% IACS. An alloy in accordance with this invention having about 2.5% manganese will still achieve electrical conductivity of at least about 10% IACS. It will also be shown hereinafter that the manganese addition to the alloys of this invention has a favorable impact on the bend formability of the alloy.

The manganese in the alloy of this invention provides a synergistic interaction with the cobalt which is believed to underly many of the improvements realized by the alloy. The cobalt in commercial alloy CDA C68800 is believed to form a fine precipitate of the compound CoAl which provides the desired grain refining action. The manganese modified alloy of this invention is believed to form at least two different precipitates, one comprising pure cobalt and the other comprising a Co-Mn-Al compound of unknown stoichiometry. The presence of two different precipitates should result in improved grain refinement. The precipitates in the alloys of this invention may also be finer than the ones in CDA Alloy C68800. A finer precipitate should provide a higher work hardening rate. For example, a higher yield strength should be obtainable for a given amount of cold work as compared to CDA Alloy C68800.

Manganese in the alloy of this invention also increases the solubility of cobalt in the base alloy. This should provide improved softening resistance and better control of the precipitation treatment. For example, a lower solution treatment temperature can be employed.

Manganese in the alloy of this invention further provides a surprising improvement in the cleaning of the alloy. Normally manganese when added to a copper alloy is believed to make it more difficult to clean. In the alloy of this invention, however, it is believed that manganese modifies the alumina film to make it easier to chemically attack and thereby easier to remove.

The alloys of this invention preferably should be readily hot workable as by hot rolling. Therefore, any alloying additions preferably should be limited to amounts which will not substantially adversely affect hot workability.

The present invention will more readily be understood from a consideration of the following illustrative examples:

EXAMPLE I

Alloys were prepared having nominal compositions as set forth in Table I.

TABLE I

| | NOMINAL COMPOSITIONS Weight Percentages | | | | |
|---|---|---|---|---|---|
| Alloy No. | Cu | Zn | Al | Co | Mn |
| 1 | 73.5 | 22.70 | 3.4 | 0.4 | — |
| 2 | 74.3 | 22.70 | 2.6 | 0.4 | — |
| 3 | 85.6 | 12.00 | 2.0 | 0.4 | — |
| 4 | 73.5 | 18.70 | 3.4 | 0.4 | 4.0 |
| 5 | 73.9 | 18.70 | 3.4 | — | 4.0 |
| 6 | 73.5 | 21.70 | 3.4 | 0.4 | 1.0 |
| 7 | 73.5 | 20.70 | 3.4 | 0.4 | 2.0 |

The alloys were cast by the Durville method from a temperature of about 1090° C. Alloy 1 represents the commercial composition of CDA Copper Alloy C68800. Alloys 2 and 3 represent other alloys in the copper-aluminum-zinc-cobalt family. Alloys 4, 6 and 7 are intended to show the effect of manganese additions on copper-zinc-aluminum-cobalt alloys. Alloy 5 is intended to show the effect of manganese on a copper-zinc-aluminum alloy without cobalt.

After casting the alloys were soaked at 840° C. for two hours and hot-rolled to about 0.4 inch gauge. They were then annealed at 500° C. for four hours, surface milled, cold-rolled and interannealed as required, at about 450° to 550° C. for one hour, to provide strip at 0.030 inch gauge after a final cold reduction of either 20% or 45%.

The tensile properties of the alloys with respective 20% or 45% final cold reductions are set forth in Table II.

TABLE II

| | TENSILE PROPERTIES | | |
|---|---|---|---|
| Alloy No. | 0.2% YS, ksi | UTS, ksi | % Elong. |
| 20% CR | | | |
| 1 | 87.8 | 104.0 | 9.5 |
| 2 | 84.0 | 103.0 | 7.5 |
| 3 | 76.0 | 87.5 | 11.0 |
| 4 | 92.5 | 106.0 | 8.0 |
| 5 | 80.0 | 90.5 | 16.0 |
| 6 | 91.0 | 103.5 | 8.5 |
| 7 | 90.5 | 103.0 | 10.0 |
| 45% CR | | | |

TABLE II-continued

| | TENSILE PROPERTIES | | |
|---|---|---|---|
| Alloy No. | 0.2% YS, ksi | UTS, ksi | % Elong. |
| 1 | 100.0 | 125.0 | 3.0 |
| 2 | 97.5 | 121.3 | 3.5 |
| 3 | 90.0 | 108.8 | 4.3 |
| 4 | 107.0 | 126.5 | 3.0 |
| 5 | 104.3 | 119.8 | 2.8 |
| 6 | 102.0 | 126.5 | — |
| 7 | 106.0 | 126.0 | 2.0 |

A comparison of the properties of the Alloys 4, 6 and 7 with that of Alloy 1 shows that there has been no loss in tensile strength relative to commercial alloy CDA C68800. The presence of cobalt provides increased strengthening as shown by the comparison of Alloys 4 and 5. The manganese addition has a beneficial effect on tensile properties, however, the zinc or aluminum level and the addition of cobalt play a more significant role with respect to those properties.

EXAMPLE II

Bending stress relaxation tests were conducted on each of the alloys from Example I at 105° C. after 20% and 45% cold reductions, respectively. In these tests, specimens were initially loaded to a stress equivalent to about 80% of the 0.2% yield strength and stress remaining was then measured as a function of time. The stress relaxation data are compiled in Table III which shows the stress remaining in percent stress remaining after 1,000 and 100,000 hours. Percent stress remaining represents the relaxation resistance of the alloy with strength differences normalized out.

TABLE III

| | STRESS RELAXATION DATA AT 105° C. | | | | |
|---|---|---|---|---|---|
| Alloy No. | Initial Stress ksi | Stress Remaining After 1,000 Hours, ksi | % Stress Remaining After 1,000 Hours | Stress Remaining After 100,000 Hours, ksi | % Stress Remaining After 100,000 Hours |
| 20% CR | | | | | |
| 1 | 69.1 | 43 | 62 | 32 | 47 |
| 2 | 63.4 | 37 | 58 | 27 | 43 |
| 3 | 58.3 | 31 | 53 | 23 | 39 |
| 4 | 72.9 | 57 | 78 | 51 | 70 |
| 5 | 63.2 | 53 | 84 | 49 | 78 |
| 6 | 70.0 | 50 | 71 | 40 | 57 |
| 7 | 69.6 | 53 | 76 | 45 | 65 |
| 45% CR | | | | | |
| 1 | 77.8 | 45 | 57 | 33 | 42 |
| 2 | 76.5 | 42 | 54 | 31 | 40 |
| 3 | 70.1 | 37 | 53 | 27 | 38 |
| 4 | 82.6 | 59 | 71 | 52 | 62 |
| 5 | 82.7 | 62 | 75 | 55 | 66 |
| 6 | 79.5 | 51 | 64 | 40 | 50 |
| 7 | 82.8 | 56 | 67 | 46 | 55 |

The above data show that the alloy of this invention with manganese provides a substantial improvement in stress remaining and percent stress remaining compared to CDA Copper Alloy C68800 and the other copper-zinc-aluminum-cobalt base alloys. These improvements are found over a wide range of zinc and aluminum contents and are not dependent on the presence of cobalt.

EXAMPLE III

A series of alloys were prepared in accordance with the processing described by reference to Example I to provide each with a 0.2% YS of about 100 ksi. The alloys comprised a base CDA alloy C68800 composition to which manganese was added in varying amounts as a replacement for zinc in the base alloy composition. The base alloy composition being given as that set forth as Alloy 1 in Table I. The stress remaining was then determined after 100,000 hours at 105° C. In these tests as in Example II, the specimens were initially loaded to a stress equivalent to about 80% of the 0.2% yield strength, and the stress remaining was determined at the end of the 100,000 hours. The results of these tests are plotted in FIG. 1. It is surprisingly shown as aforenoted that the stress relaxation resistance of the alloy markedly increases with increasing manganese content up to about 2% manganese and then the rate of increase levels out.

EXAMPLE IV

A series of alloys having a base composition corresponding to Alloy No. 1 in Table I were modified by the addition of varying amounts of manganese in substitution for zinc and processed as in Example I. The respective electrical conductivities of those alloys in the annealed condition were measured. The results of these tests are plotted in FIG. 2. It is apparent from FIG. 2 that the manganese addition adversely affects the electrical conductivity of the alloy, however, the alloy can achieve acceptable levels of conductivity over a wide range of manganese contents. Preferably, the maximum manganese content is, therefore, about 2.5%, if at least 10% IACS conductivity is desired.

EXAMPLE V

The effect of manganese upon the bend formability of CDA alloy C68800 was determined by comparing bend properties for a series of alloys with varying additions of manganese to a base composition in accordance with Alloy 1 of Table I wherein the manganese was substituted for zinc. The alloys were prepared in accordance with the process described by reference to Example I, with a final cold reduction of about 45% to achieve a 0.2% yield strength of about 100 ksi. It is apparent from a consideration of the data presented in Table IV that the bend formability of the alloys in accordance with this invention is improved as compared to CDA alloy C68800 at the same strength level.

TABLE IV

| BAD WAY BEND PROPERTIES | | |
|---|---|---|
| % Mn | MBR at 0.03" Thickness in 64ths Inches | R/t |
| 0 | 12 | 6.2 |
| 0.7 | 10 | 5.2 |
| 1.6 | 8 | 4.2 |
| 3.5 | 8 | 4.2 |

Definition of Abbreviations
YS = yield strength at 0.2% offset
UTS = ultimate tensile strength
ksi = thousands of pounds per square inch
% Elong. = percent elongation in a two inch gauge length
MBR = minimum bend radius
R/t = ratio of minimum bend radius to strip thickness All percentage compositions set forth herein are by weight.

All patents set forth in this application are intended to be incorporated by reference herein.

It is apparent that there has been provided in accordance with this invention an improved copper base alloy which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A copper base alloy having improved stress relaxation resistance consisting essentially of: about 10.0 to 31% zinc; about 1.0 to 5.0% aluminum; about 0.1 to 3.0% cobalt; about 0.5 to 8% manganese and the balance essentially copper.

2. An alloy as in claim 1 wherein manganese is present from about 0.8 to 6%.

3. An alloy as in claim 1 wherein manganese is present from about 1.1% to 4%.

4. An alloy as in claim 2 wherein aluminum is from about 2.0 to 4%, zinc is from about 15 to 25% and cobalt is from about 0.1 to 1%.

5. An alloy as in claim 4 wherein manganese is present from about 1.1 to 4%.

6. An alloy as in claim 5 having an essentially all alpha phase microstructure.

7. An alloy as in claim 5 in the cold worked condition.

8. An alloy as in claim 4 having an electrical conductivity of at least 10% IACS wherein said manganese is from about 1.1 to 2.5%.

9. An alloy as in claim 1 having at least two precipitates of different compositions.

10. An alloy as in claim 9 wherein one of said precipitates comprises cobalt and another of said precipitates comprises a cobalt-manganese-aluminum compound.

* * * * *